US005453307A

United States Patent [19]

Rezmer

[11] Patent Number: 5,453,307

[45] Date of Patent: Sep. 26, 1995

[54] HORN MOUNT WITH DISPLAY PORTION

[76] Inventor: Leonard D. Rezmer, 14080 N. Elm Rd., Montrose, Mich. 48457

[21] Appl. No.: 202,789

[22] Filed: Feb. 28, 1994

[51] Int. Cl.[6] ..... B44C 5/02

[52] U.S. Cl. ..... 428/16; 428/542.4; 428/913.3; 434/296

[58] Field of Search ..... 428/542.4, 913.3, 428/16; 434/296; D11/133, 132, 134

[56] References Cited

U.S. PATENT DOCUMENTS

D. 343,373 1/1994 Nelson ..... D11/133

713,030 11/1902 Werts ..... 40/156

2,242,148 5/1941 Sanders ..... 40/156

3,541,714 11/1970 Bruck ..... 40/156

*Primary Examiner*—Alexander S. Thomas

*Attorney, Agent, or Firm*—Weintraub, Duross & Brady

[57] ABSTRACT

A mount for displaying horns of an animal has a base member. The base has a display portion formed therein. The display portion comprises an opening and a recess formed in the base and in communication with each other. A cover and a backing enclose a photograph or other pictorial to be displayed in the display portion. The cover and backing fit within the recess, but may not pass forwardly into the opening. A nail slot may be provided to facilitate hanging of the mount to a wall or other surface.

6 Claims, 1 Drawing Sheet

HORN MOUNT WITH DISPLAY PORTION

BACKGROUND OF THE INVENTION

1. Field of the Invention

The present invention concerns a mount for exhibiting animal horns. More particularly, the present invention concerns a horn mount having a display portion for photographs or other pictorials.

2. Description of the Prior Art

Man, from time immemorial, has hunted wild game both for sustenance and sport. The skill involved in tracking and bagging game is a source of justifiable pride and has led to various means to show the animals successfully hunted. Some animal hides serve well as floor or wall coverings, such as bear skin rugs. Other hides are for the fabrication of clothing. Animals with horns, such as antlers, may have these horns mounted onto a plaque or other trophies.

It is commonly known to take the head and a portion of the neck, after preparation by a taxidermist, and mount it on a wooden plaque. However, such trophies are large and heavy, often clashing with the room decor. A less cumbersome alternative is to mount only the horns or antlers upon a trophy plaque. Yet, these horn trophies lack any description of the animal captured, save the horns. What therefore is needed is a trophy that can both reduce the size of the mount, yet communicate the size and presence of the animal. It is to this need that the present invention is directed.

SUMMARY OF THE INVENTION

The present invention is a horn mount for showing at least one horn or antler from an animal hunted. The horn mount of the present invention comprises:

(a) a base having a forward surface and a rearward surface, the base having an opening formed therein, the base having a recess formed rearwardly of and in communication with the opening; and (b) a display cover deployed within the recess formed in the base.

The horn mount may additionally comprise means for hanging the mount to a wall. Also, the horn mount may comprise means for attaching the at least one horn to the base of the mount.

The present invention will be better understood by the following detailed description, with reference therein to the accompanying drawings, wherein like reference numerals refer to like elements, and wherein:

DETAILED DESCRIPTION OF THE PREFERRED EMBODIMENT

Figure 1:
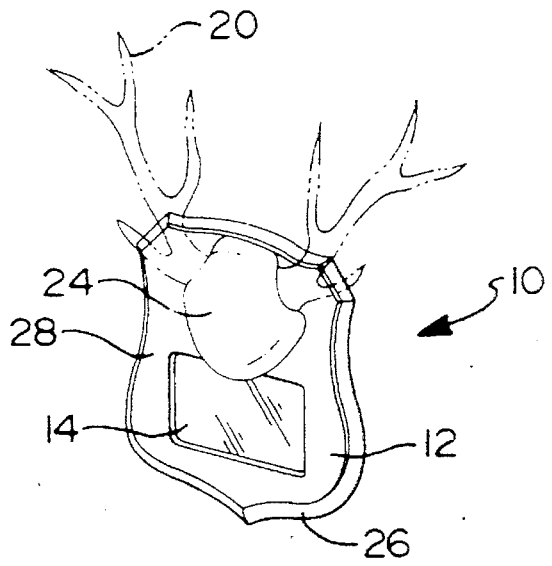
FIG. 1 is a forward perspective view of the horn mount of the present invention.
Figure 2:
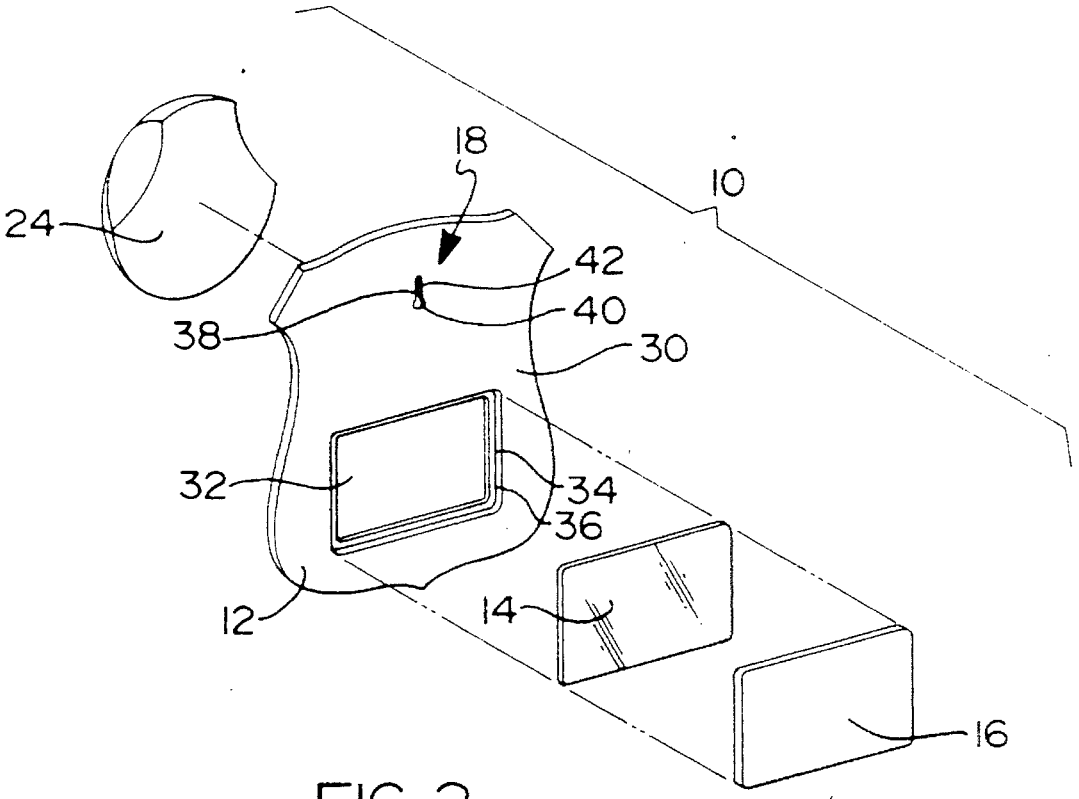
FIG. 2 is an exploded rearward view of the horn mount of the present invention.

Referring now to FIGS. 1 and 2, there is shown the present invention, a horn mount 10. The horn mount 10 comprises a base 12, a display cover 14, a backing 16 and a means 18 for hanging the mount 10 on a wall.

At the outset, it is noted that the horn mount 10, as shown in FIG. 1, has mounted therein a pair of deer antlers 20, shown in broken line. The antlers 20 are connected to the base 12 by suitable means for attaching (not shown). Such means for attaching may comprise nails, screws or other fasteners disposed through the antlers 20 and into the base 12. Alternately, gluing of the antlers 20 to the base 12 can be effected.

The antlers 20 are left lodged in a portion of the skull of the animal covered by a display cloth 24. The cloth 24 is preferably selected from velvet, chamois or other similarly decorative material. The cloth 24 is secured down onto the skull portion by glue, staples, stitching or similar means, as are known.

The base 12 of the horn mount 10 is a unitary member, ideally formed of wood or other decorative material. Suitable alternative materials include metallic alloys, such as brass, or the like. As seen in FIG. 1, the base 12 may have a decorative edge 26 formed thereon.

The base 12 has a forward surface 28 and a rearward surface 30. Between these surfaces 28, 30 the base 12 has a thickness defined. Upon the forward surface 28, there is, formed an opening 32 thereon. The opening 32 extends from the forward surface 28 through the thickness to the rearward surface 30. The base 12 has additionally a recess 34 formed perimetrically around the opening 32. The recess 34 is larger in area than the opening 32, thus an edge 36 is defined therewithin the thickness of the base 12.

A display cover 14 is ideally formed of a clear plexiglass. Alternately, glass or other transparent, durable material can be elected, if desired. The cover 14 may be formed in any configuration desired, such as a rectangle, ellipse, circle, etc. It is to be noted, however, that there must be a commonality of configuration between the cover 14 and the recess 34. This is because the edge 36, defined by the meeting of the opening 32 and the recess 34, contacts and prevents the cover 14 from dislodging forwardly through the opening 32. The configurations of the cover 14 and the recess 34 must also be compatible, since the cover 14 is deployed in the base 12 through the recess 34. Thus, if the cover 14 were of a larger circumference than the recess 34, the cover 14 could not be deployed in the recess 34.

The backing 16 is formed of a lightweight material, such as cardboard or the like. The backing 16 is deployed rearwardly of the cover 14 within the recess 34 similar to the cover 14. The backing 16 and the cover 14 have placed therebetween a photograph, a license or other item for display (not shown). The backing 16 is configured similarly to the recess 34, such that the backing 16 may fit snugly therein. Thus, the photograph and the cover 14 are held in place by the backing 16.

The means 18 for hanging, as shown in FIG. 2, comprises, in the preferred embodiment, a nail slot 38. The nail slot 38 is formed in the rearward surface. The rearward surface faces the wall or other surface (not shown) to which the mount 10 will be hung. The slot 38, preferably, has a rounded opening 40 at the bottom or lower portion. Following above or upwardly from this rounded opening 40 is a furrow 42. The width of the furrow 42 corresponds to that of the nail, screw or other fastener deployed in the wall. A channel (not shown) is formed in the base below the furrow 42. The channel is of a width substantially similar to the rounded opening 40, so that the head of the fastener may travel therethrough while the stem of the fastener moves within the furrow 42. By this seating of the fastener into the slot 38, the mount 10 is hung.

An alternate means 18 for hanging is envisioned to be a small bracket fastened to the rearward surface of the mount 10. The bracket is of the known types having a saw-toothed surface therebelow. The head of a fastener deployed in the wall, then rests under the bracket.

Having thus described the invention, what is claimed is:

1. A horn mount for showing at least one horn of an animal, the horn mount comprising:

(a) a base having a forward surface and a rearward surface, the base having an opening formed therein, the base having a recess formed rearwardly of and in communication with the opening;

(b) a display cover deployed within the recess formed in the base; and (c) means for attaching the at least one horn to the base.

2. The horn mount of claim 1, further comprising:

means for hanging the mount.

3. The horn mount of claim 2, wherein the means for hanging comprises a nail slot found in the rearward surface of the base.

4. A horn mount for showing at least one hour of an animal, the horn mount comprising:

(a) a base having a forward surface and a rearward surface, the base having an opening formed therein, the base further having a recess formed therein rearwardly of the opening, the base having means for hanging the mounting;

(b) a display cover deployed with the recess of the base;

(c) a display back deployed with the recess of the base rearwardly of the display cover; and (d) means for attaching the at least one horn to the base.

5. The horn mount of claim 4, the mount further comprising a display cloth around the at least one horn.

6. A horn mount comprising:

(a) a base having a forward surface and a rearward surface, the base having an opening formed therein, the base having a recess formed rearwardly of and in communication with the opening;

(b) a display cover deployed with the recess of the base;

(c) a display backing deployed with the recess of the base rearwardly of the cover;

(d) at least one horn of an animal;

(e) means for attaching the at least one horn to the base;

(f) a display cloth disposed around the at least one horn; and (g) means for hanging the mount.

* * * * *